US011939896B2

(12) United States Patent
Kashiwabara et al.

(10) Patent No.: US 11,939,896 B2
(45) Date of Patent: Mar. 26, 2024

(54) BLOWBY GAS RETURN APPARATUS AND HEAD COVER

(71) Applicant: MAZDA MOTOR CORPORATION, Hiroshima (JP)

(72) Inventors: Takashi Kashiwabara, Hiroshima (JP); Yuki Tsukagoshi, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 18/187,348

(22) Filed: Mar. 21, 2023

(65) Prior Publication Data

US 2023/0349307 A1 Nov. 2, 2023

(30) Foreign Application Priority Data

Apr. 28, 2022 (JP) ..... 2022-074274

(51) Int. Cl.
*F01M 13/04* (2006.01)

(52) U.S. Cl.
CPC ..... *F01M 13/0416* (2013.01)

(58) Field of Classification Search
CPC ..... F01M 13/0416; F01M 13/0415
See application file for complete search history.

(56) References Cited

FOREIGN PATENT DOCUMENTS

| | | | | |
|---|---|---|---|---|
| JP | H05-030412 U | 4/1993 | | |
| JP | 2592095 Y2 | 3/1999 | | |
| WO | WO-2019230310 A1 * | 12/2019 | ..... | F01M 13/04 |

* cited by examiner

*Primary Examiner* — Jacob M Amick
*Assistant Examiner* — Charles J Brauch
(74) *Attorney, Agent, or Firm* — Studebaker & Brackett PC

(57) ABSTRACT

A blowby gas return apparatus is provided that achieves inhibition of condensation of water vapor in blowby gas in branched return passages. A blowby gas return apparatus that returns blowby gas generated in an engine having a plurality of cylinders to an intake system of the engine includes a distribution portion inside a head cover of the engine, and distributes the blowby gas to intake paths of the cylinders. The distribution portion includes an introduction portion through which the blowby gas is introduced and a plurality of branch passages communicating with the introduction portion, plurality of branch passages branching from the introduction portion to communicate with the intake paths.

13 Claims, 11 Drawing Sheets

BLOWBY GAS RETURN APPARATUS AND HEAD COVER

TECHNICAL FIELD

The present disclosure relates to a blowby gas return apparatus and a head cover.

BACKGROUND

Conventionally, there has been known a blowby gas return apparatus having a structure that returns blowby gas from a crankcase to an intake port of an engine through an intake manifold to prevent the blowby gas leaking from a combustion chamber of the engine into the crankcase from polluting the atmosphere and degrading lubricating oil.

In such a return apparatus, since blowby gas is returned to the intake manifold, the blowby gas is introduced into the intake manifold still in a cold state at the start of the engine in a cold climate area. Thus, water vapor contained in the blowby gas may be rapidly cooled and may condense into ice masses. If the ice masses are sucked into the engine combustion chamber, the ice masses cause an accidental fire.

Thus, to inhibit condensation of water vapor in blowby gas, it is required to return the blowby gas to each cylinder near the combustion chamber, which is hard to cool down and easy to warm up quickly, to inhibit condensation of water vapor. On the other hand, it is also required to uniformly return blowby gas to the cylinders to prevent variations of intake air between the cylinders.

As a technique created on the basis of these requirements, Japanese Utility Model Registration No. 2592095 discloses a structure including, as passages for blowby gas, a return pipe through which blowby gas is returned from a crank case to a head cover, an introduction portion communicating with the head cover and a mating face of an intake manifold and a cylinder head, a first gas passage communicating with a downstream end of the introduction portion and extending between a plurality of intake branch pipes of the intake manifold, and a plurality of second gas passages branching from the first gas passage to communicate with the intake branch pipes, the first gas passage and the plurality of second gas passages being formed in the mating face.

In this structure, blowby gas can be returned to each intake port of the cylinder head through the branched return passages (that is, the plurality of second gas passages) formed in the mating face of the intake manifold and the cylinder head.

SUMMARY

In the structure described above, although condensation of water vapor in blowby gas is inhibited by the return passages branching off in the mating face of the intake manifold and the cylinder head, it is not possible to prevent heat from escaping to the intake manifold while the blowby gas passes through the branched return passages formed in the mating face, and there is still room for improvement in inhibiting condensation of water vapor.

The present disclosure has been made in view of the circumstances as described above, to provide a blowby gas return apparatus that can achieve inhibition of condensation of water vapor in blowby gas in branched return passages.

In order to solve the problem described above, a blowby gas return apparatus of the present disclosure returns blowby gas generated in an engine having a plurality of cylinders to an intake system of the engine, characterized in that the blowby gas return apparatus includes a distribution portion that is provided inside a head cover of the engine and distributes the blowby gas to intake paths of the cylinders, and the distribution portion includes an introduction portion through which the blowby gas is introduced and a plurality of branch passages communicating with the introduction portion, the plurality of branch passages branching from the introduction portion to communicate with the intake paths.

According to such a configuration, inside the head cover of the engine having the plurality of cylinders, the distribution portion including the introduction portion through which the blowby gas is introduced and the plurality of branch passages communicating with the introduction portion and branching from the introduction portion is provided. Thus, even in a cold climate area, the head cover is warmed up quickly at the start of the engine, and the blowby gas passing through the inside of the introduction portion and the plurality of branch passages of the distribution portion inside the head cover is also warmed up promptly and can be distributed and returned to the intake paths of the cylinders. Accordingly, it is possible to inhibit condensation of water vapor contained in the blowby gas in the branched return passages.

Preferably, the blowby gas return apparatus described above further includes a communication passage that allows an intake port constituting the intake path of the cylinder and an outlet of the branch passage to communicate with each other inside a cylinder head of the engine.

According to such a configuration, the blowby gas distributed by the distribution portion inside the head cover can be directly introduced into the intake port through the communication passage inside the cylinder head where temperature largely increases, and it is thus possible to supply the blowby gas to the cylinder while reliably preventing condensation and freezing of water vapor in the blowby gas.

In the blowby gas return apparatus described above, preferably, the plurality of branch passages have a tournament structure branching from the introduction portion in a plurality of stages.

In such a configuration, a large number of branch passages can be branched from one introduction portion within a limited space inside the head cover. Also, in this structure, a large number of branch passages can be provided without changing the width of the branch passages, and it is thus possible to efficiently distribute the blowby gas.

In the blowby gas return apparatus described above, preferably, the plurality of branch passages having the tournament structure are disposed centered on an intermediate position in an array direction of the plurality of cylinders.

In such a configuration, the blowby gas can be uniformly fed to the intake paths of the plurality of cylinders with a simple configuration. Also, such a tournament structure enables easy design of the distribution portion.

In the blowby gas return apparatus described above, preferably, the distribution portion includes, in a branch part where two of the branch passages branch off in the tournament structure, a narrowing portion that narrows a channel of any one of the two branch passages.

In such a configuration, in the branch part where two of the branch passages of the tournament structure in the distribution portion branch off, the narrowing portion narrows the channel of any one of the two branch passages, thereby enabling reduction in the flow rate of blowby gas. Thus, it is possible to individually adjust the flow rate of blowby gas in each of the branch passages branching off in the plurality of stages in the tournament structure. As a result, it is possible to uniformly feed the blowby gas to the intake paths of the plurality of cylinders while maintaining high uniformity and reduce variations in air-fuel ratio between the cylinders.

In the blowby gas return apparatus described above, preferably, the narrowing portion is composed of a partition wall that partially partitions inside of the branch passage.

In such a configuration, by providing, as the narrowing portion, the partition wall that partially partitions the inside of the branch passage, it is possible to more accurately set the flow rate of blowby gas flowing through each branch passage.

Preferably, the blowby gas return apparatus described above further includes a lubricating oil passage that is disposed adjacent to the distribution portion and through which lubricating oil supplied to a valve system of the engine flows.

According to such a configuration, the lubricating oil supplied to the valve system of the engine flows through the lubricating oil passage adjacent to the distribution portion immediately after the start of the engine, which makes it possible to immediately thaw ice formed inside the branch passage by warming the distribution portion with heat of the lubricating oil. In addition, even after the engine pauses thereafter (that is, after soaking), blowby gas remaining inside the distribution portion is warmed with the heat of the lubricating oil, and it is thus possible to inhibit condensation of water vapor contained in the blowby gas.

Preferably, the blowby gas return apparatus described above further includes a separation portion that is provided inside the head cover, communicates with the introduction portion, and separates oil contained in the blowby gas.

According to such a configuration, after the separation portion separates oil from the blowby gas to purify the blowby gas, the distribution portion can distribute the purified blowby gas to the branch passages after the purified blowby gas passes through the introduction portion, and it is thus possible to prevent oil from adhering to the inside of the branch passages. In addition, since the separation portion is provided inside the head cover, even in a cold climate area, the separation portion can separate oil in blowby gas warmed up inside the head cover, which improves the separation efficiency.

In the blowby gas return apparatus described above, preferably, the separation portion extends in an array direction of the plurality of cylinders and is disposed on an exhaust path side of the plurality of cylinders inside the head cover, the distribution portion extends in the array direction and is disposed on a side with the plurality of intake paths inside the head cover, an outlet of the separation portion and the introduction portion of the distribution portion are disposed on an end on the same side in the array direction inside the head cover, and the blowby gas return apparatus further includes a return pipe that extends in a direction perpendicular to the array direction and allows the outlet of the separation portion and the introduction portion of the distribution portion to communicate with each other.

According to such a configuration, since the return pipe extends in the direction perpendicular to the array direction of the plurality of cylinders and allows the outlet of the separation portion and the introduction portion of the distribution portion to communicate with each other, it is possible to shorten the length of the return pipe, prevent reduction in the temperature of the blowby gas moving from the separation portion to the distribution portion, and more reliably inhibit condensation of water vapor contained in the blowby gas.

In the blowby gas return apparatus described above, preferably, the return pipe includes a restriction portion that allows flow of the blowby gas from the separation portion to the distribution portion and restricts flow of the blowby gas from the distribution portion to the separation portion.

According to such a configuration, although the distribution portion has a higher pressure than the separation portion when the engine operates in a boosting region, the restriction portion of the return pipe can restrict backflow of the blowby gas from the distribution portion to the separation portion.

A head cover of the present disclosure is characterized by including the distribution portion described above.

According to the configuration of such a head cover, the head cover includes the distribution portion described above, that is, the distribution portion that is provided inside the head cover of the engine having the plurality of cylinders and includes the introduction portion through which the blowby gas is introduced and the plurality of branch passages communicating with the introduction portion and branching from the introduction portion. Thus, even in a cold climate area, the head cover is warmed up quickly at the start of the engine, and the blowby gas passing through the inside of the introduction portion and the plurality of branch passages of the distribution portion inside the head cover is also warmed up promptly and can be distributed and returned to the intake paths of the cylinders. Accordingly, it is possible to inhibit condensation of water vapor contained in the blowby gas in the branched return passages.

As described above, according to the blowby gas return apparatus and the head cover of the present disclosure, it is possible to achieve inhibition of condensation of water vapor in blowby gas in branched return passages.

DETAILED DESCRIPTION

Hereinbelow, a blowby gas return apparatus according to an embodiment of the present disclosure will be described in detail with reference to the drawings.

Figure 1:
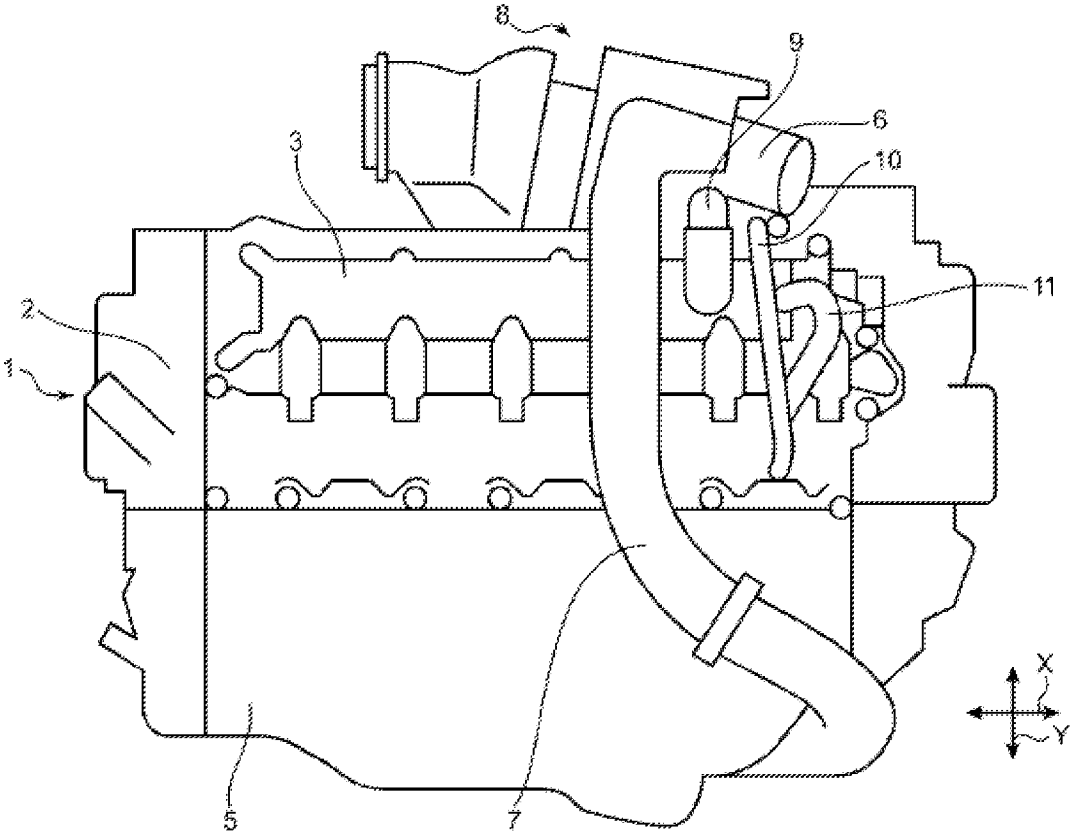
FIG. 1 is a perspective view illustrating the entire configuration of an engine having a structure in which a blowby gas return apparatus according to an embodiment of the present disclosure is provided on a head cover.
Figure 10:
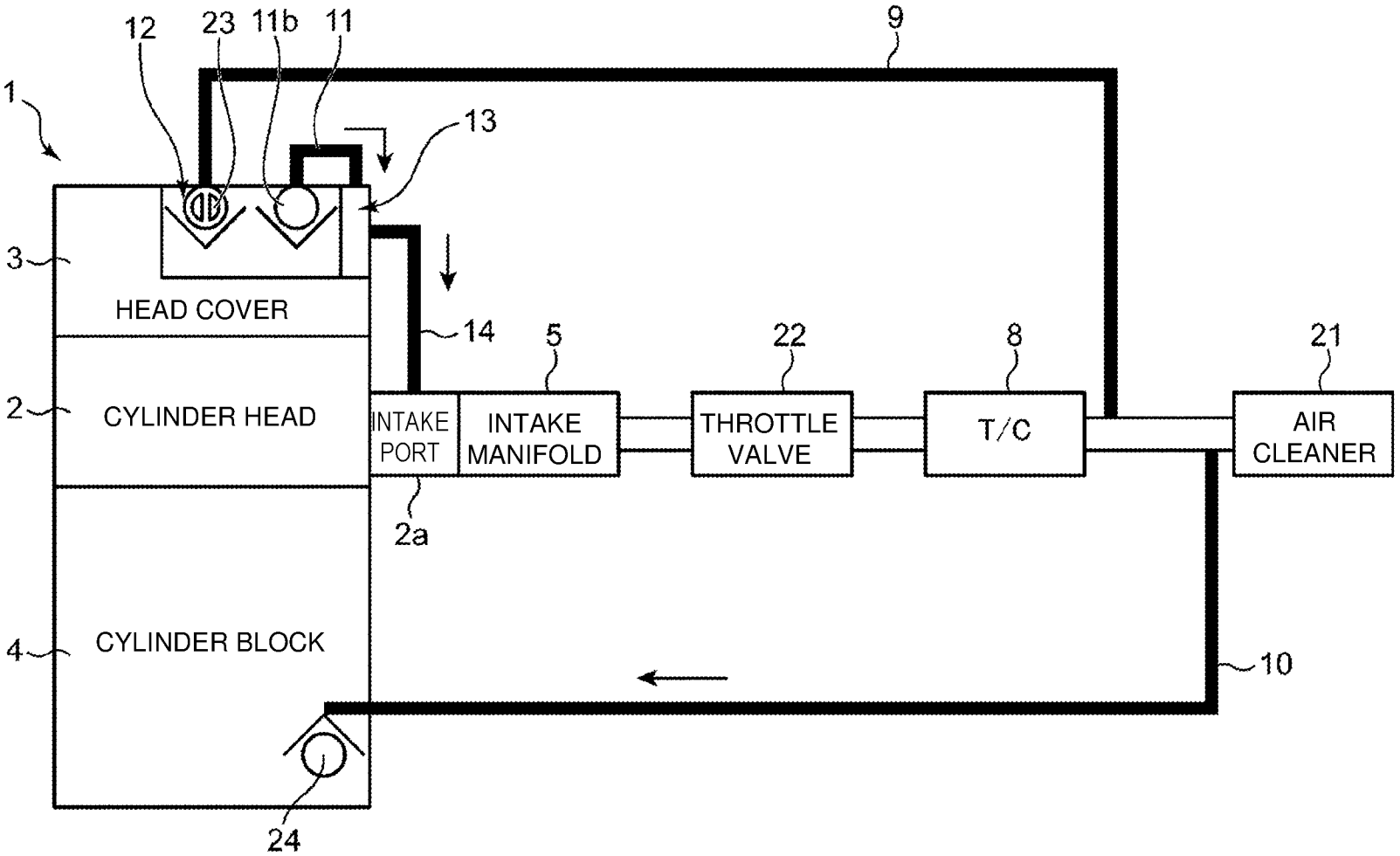
FIG. 10 is a block diagram illustrating the structure of the engine of FIG. 1 and an intake system thereof, specifically, an explanatory diagram illustrating the flow of gas inside a return pipe (PCV hose), a ventilation hose, and a breather hose during engine operation in a natural aspiration region.

As illustrated in FIGS. 1 and 10, a system relating to an engine 1 having a plurality of cylinders (in FIG. 1, an inline six-cylinder engine is illustrated) and an intake system thereof includes the engine 1 having a cylinder head 2, a head cover 3 that covers the top of the cylinder head 2, and a cylinder block 4 coupled to the bottom of the cylinder head 2, an intake manifold 5 having a plurality of intake passages connected one-to-one to a plurality of intake ports 2*a* (refer to FIG. 3) of the cylinder head 2, an introduction pipe 6 connected to an air cleaner box (not illustrated) of the engine 1, an intake pipe 7 having a downstream end connected to the intake manifold 5, and a turbocharger 8 that is connected to an upstream end of the intake pipe 7 and boosts intake air inside the introduction pipe 6.

As illustrated in FIG. 1, the system further includes a ventilation hose 9 that connects the head cover 3 (specifically, an oil separation portion 12, which will be described further below, inside the head cover 3) and an intake path on the upstream side of the turbocharger 8, a breather hose 10 that connects the cylinder block 4 and the intake path on the upstream side of the turbocharger 8, an air cleaner 21 connected to the intake path on the upstream side of the turbocharger 8, and a throttle valve 22 disposed between the turbocharger 8 and the intake manifold 5.

The engine 1 includes a blowby gas return apparatus 20 (refer to FIGS. 3 to 5) for returning blowby gas generated in the engine 1 to each intake port 2*a* serving as the intake system of the engine 1.

Figure 3:
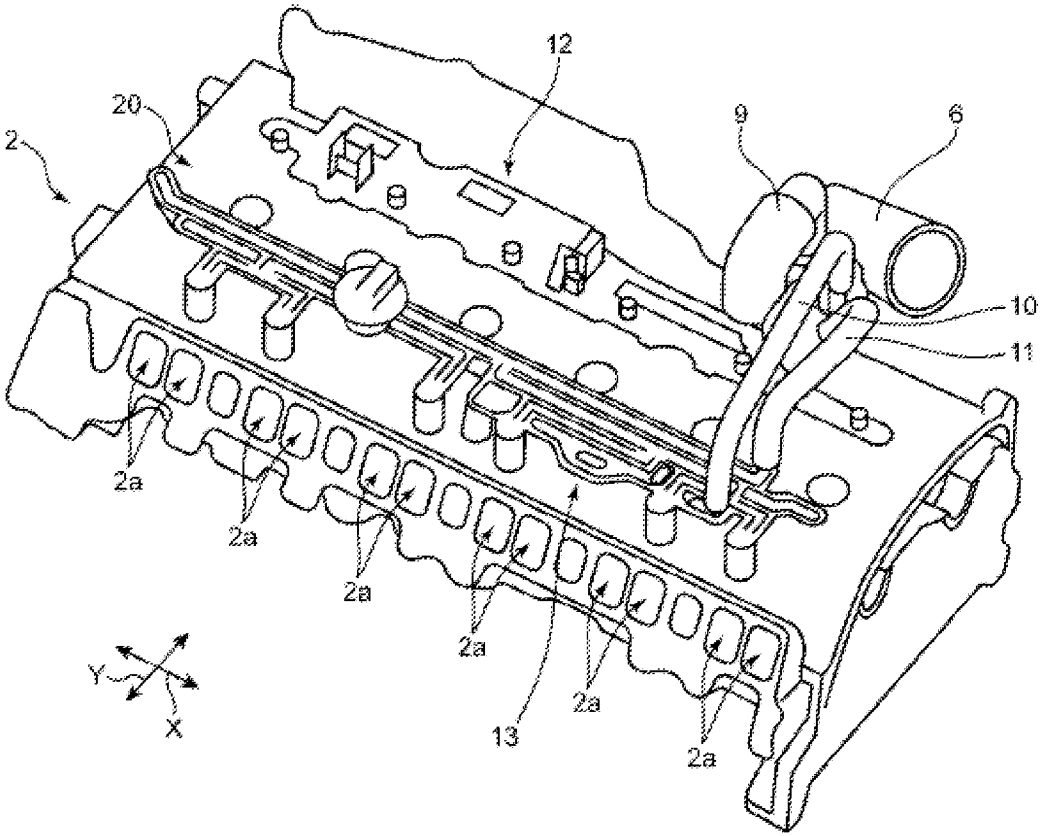
FIG. 3 is a perspective explanatory diagram illustrating the positional relationship between an oil separation portion and a distribution portion inside the head cover of FIG. 1 and peripheral components thereof.
Figure 4:
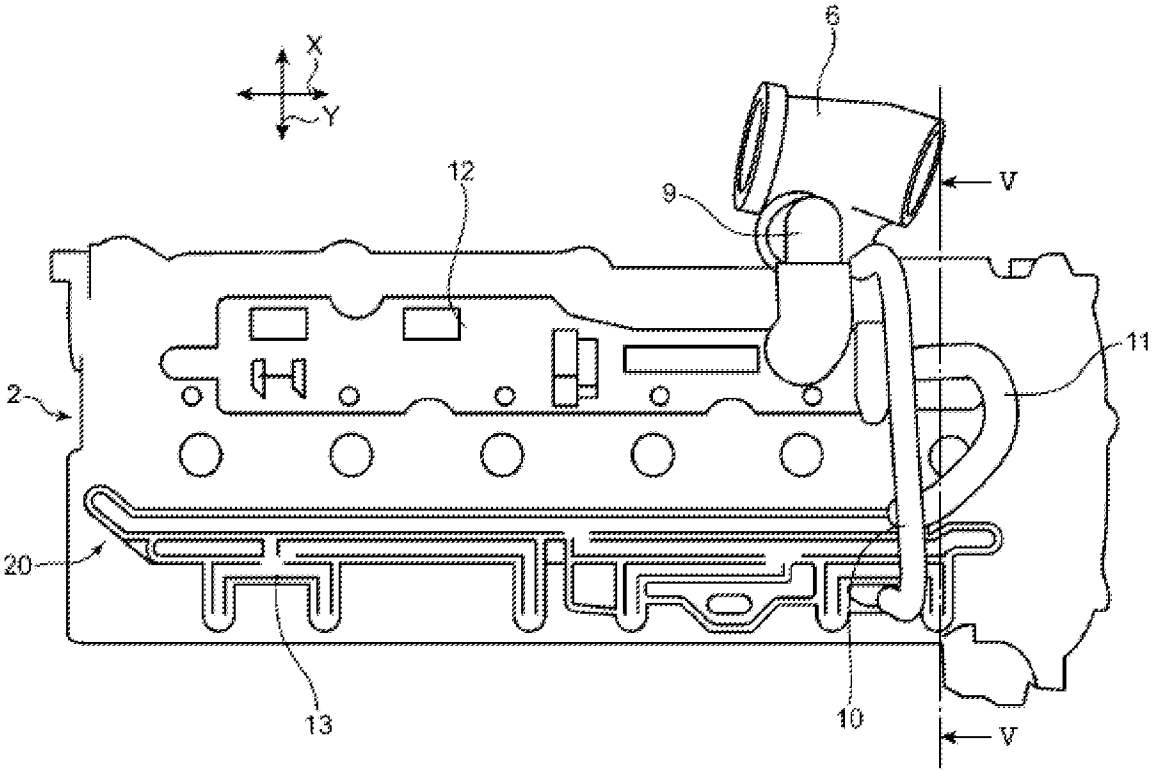
FIG. 4 is a plan explanatory diagram illustrating the positional relationship between the oil separation portion and the distribution portion inside the head cover of FIG. 1 and the peripheral components thereof.
Figure 5:
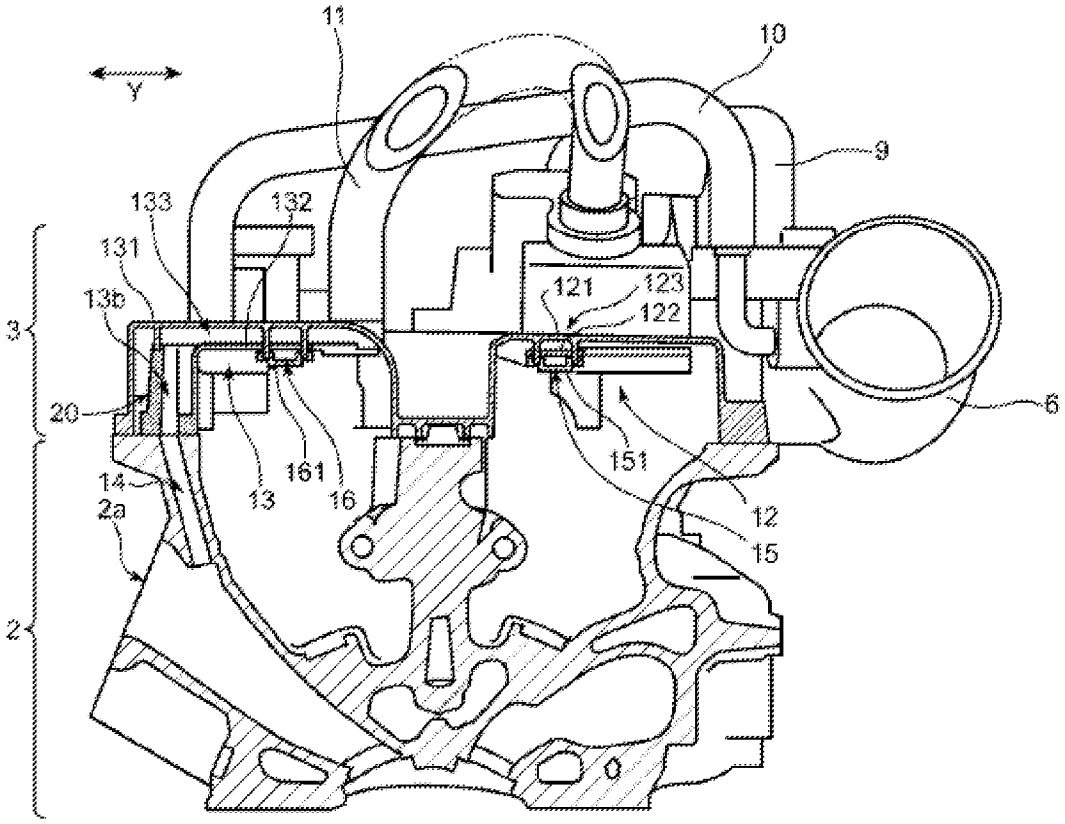
FIG. 5 is a cross-sectional view taken along line V-V of FIG. 4.

Specifically, as illustrated in FIGS. 3 to 5, the blowby gas return apparatus 20 includes the oil separation portion 12 that separates oil contained in blowby gas, a distribution portion 13 that distributes the blowby gas to the cylinders, a plurality of communication passages 14 (refer to FIG. 6) that allow the distribution portion 13 and each intake port 2*a* to communicate with each other, a return pipe 11 that allows the oil separation portion 12 and the distribution portion 13 to communicate with each other, and lubricating oil passages 15, 16 disposed adjacent to the oil separation portion 12 and the distribution portion 13, respectively. The oil separation portion 12, the distribution portion 13, and the lubricating oil passages 15, 16 are housed inside the head cover 3. The communication passage 14 is formed penetrating the cylinder head 2 in the up-down direction.

The return pipe 11 of the present embodiment is attached to the upper face of the head cover 3 and disposed passing through the outside of the head cover 3.

In the blowby gas return apparatus 20 described above, blowby gas generated in a crankcase (not illustrated) of the engine 1 is returned into the head cover 3 through an oil separator introduction opening (not illustrated). Inside the head cover 3, the blowby gas is fed to the oil separation portion 12 where oil contained in the blowby gas is separated, thereafter fed to the distribution portion 13 through the return pipe 11, distributed by the distribution portion 13, and then returned to each intake port 2*a* through the communication passage 14. Such a blowby gas return apparatus 20 is called a positive crankcase ventilation system (PCV system) and enables separation of oil in blowby gas and uniform distribution of blowby gas to the intake ports 2*a*.

Hereinbelow, the specific configuration of each constituent part of the blowby gas return apparatus 20 will be described in more detail.

As illustrated in FIGS. 2 to 5 and FIGS. 7 to 9, the distribution portion 13 is provided inside the head cover 3 and has a configuration that distributes blowby gas to the intake paths of the cylinders.

Figure 7:
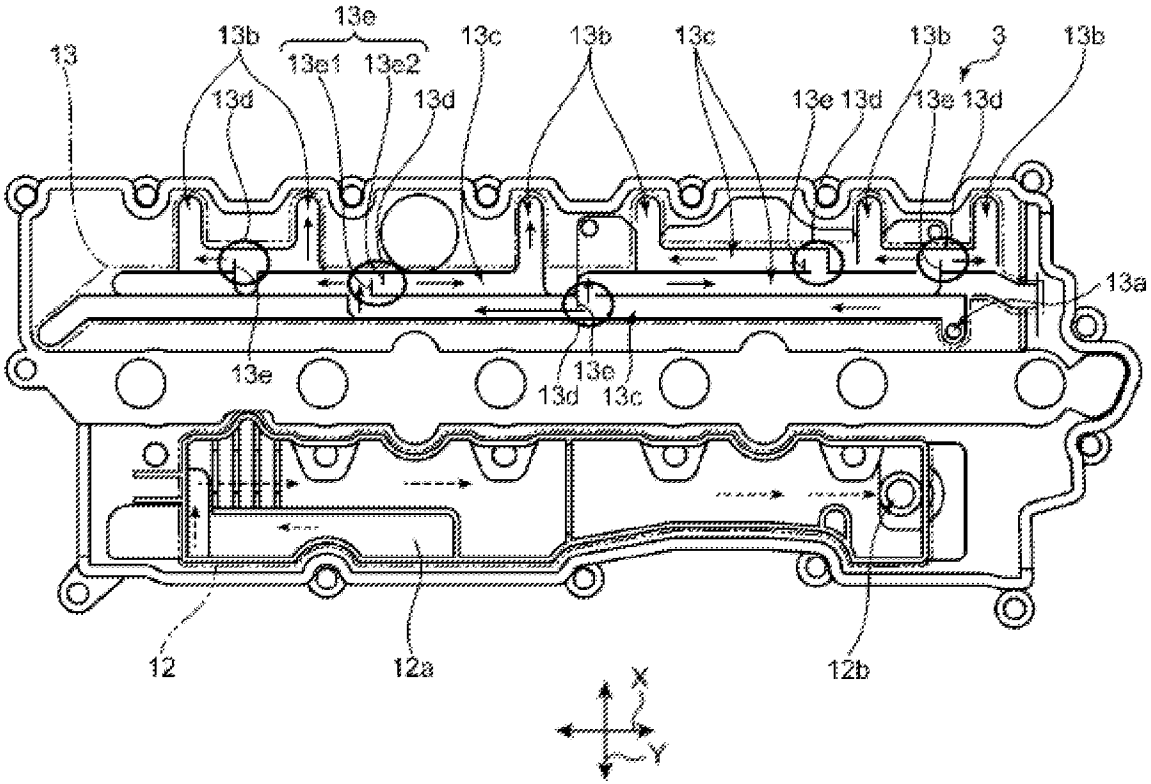
FIG. 7 is a diagram illustrating the detailed configuration of the oil separation portion and the distribution portion inside the head cover viewed from the bottom side of the head cover of FIG. 1.

As illustrated in FIG. 7, the distribution portion 13 includes an introduction portion 13*a* having an introduction opening through which blowby gas is introduced, a plurality of branch passages 13*c* having a tournament structure branching from the introduction portion 13*a* in a plurality of stages, a discharge portion 13*b* communicating with a downstream end of each of the branch passages 13*c* on the last stage (that is, an outlet of each of the branch passages 13*c*), and a partition wall 13*e* serving as a narrowing portion that partially narrows some of the branch passages 13*c*.

The plurality of branch passages 13*c* have a configuration that communicates with the introduction portion 13*a*, and branches from the introduction portion 13*a* and communicates with each intake path and, in such a configuration, in particular, have the tournament structure branching from the introduction portion 13*a* in the plurality of stages as described above in the present embodiment.

Here, the tournament structure is a structure branching from one introduction portion 13*a* to the plurality of discharge portions 13*b*, a structure with no closed loop in which the number of branch passages 13*c* and branch parts 13*d* increases from the introduction portion 13*a* toward the discharge portion 13*b*, and a structure shown in a treelike diagram or a tree diagram.

In the present embodiment, as illustrated in FIG. 7, the plurality of branch passages 13*c* having the tournament structure are disposed centered on an intermediate position in an array direction X of the plurality of cylinders.

As illustrated in FIG. 7, in the branch part 13*d* where two branch passages 13*c* branch off in the tournament structure, the partition wall 13*e* serves as the narrowing portion that narrows a channel of any one of the two branch passages 13*c* and partially partitions the inside of the branch passage 13*c*. Specifically, the partition wall 13*e* projects in the traverse cross sectional direction inside the branch passage 13*c*.

The partition wall 13*e* is provided in, for example, one of the two branch passages 13*c* where the flow rate of blowby gas is to be reduced. Specifically, of the branch passage 13*c* extending straight and the branch passage 13*c* bent at the branch part 13*d*, the partition wall 13*e* is provided in the branch passage 13*c* extending straight.

Also, in a part where more blowby gas is required to be fed to one of the two branch passages 13*c* having the larger number of discharge portions 13*b* on the last stage, the partition wall 13*e* having a labyrinth structure having a plurality of small partition walls 13*e*1, 13*e*2 in combination is provided in the branch passage 13*c* on the opposite side, thereby making it possible to largely reduce the flow rate of blowby gas in the branch passage 13*c* on the opposite side and feed more blowby gas to the desired branch passage 13*c*.

Figure 8:
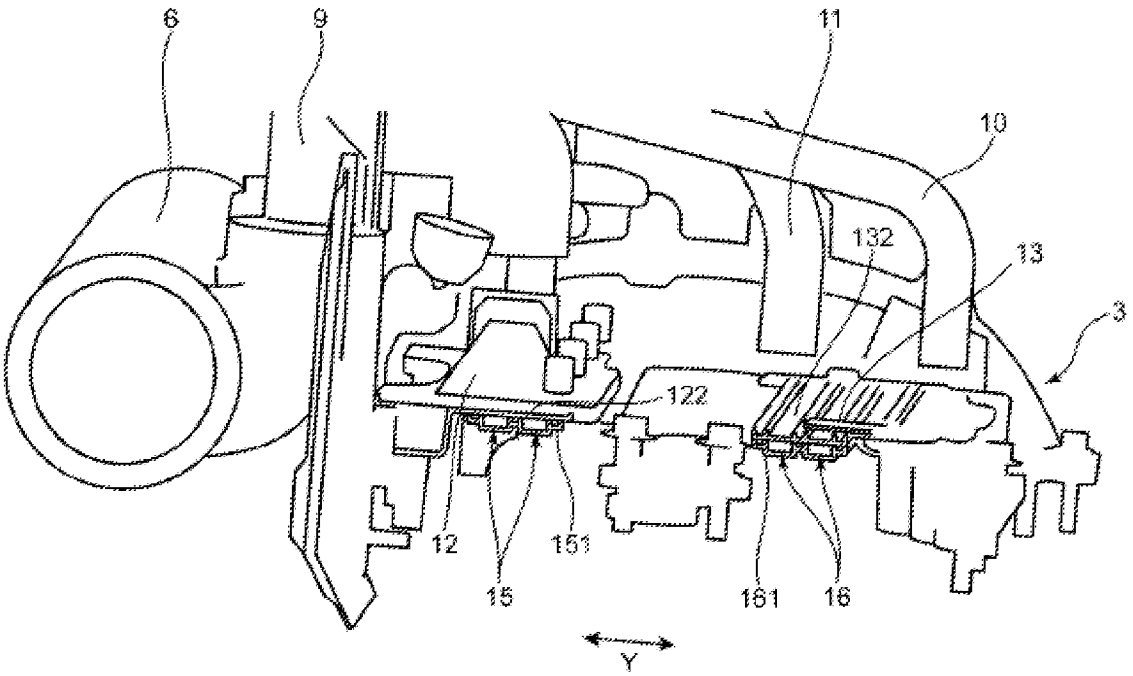
FIG. 8 is a sectional explanatory diagram illustrating a lubricating oil passage adjacent to a cylinder head side (lower side) of the oil separation portion and the distribution portion of FIG. 3.
Figure 9:
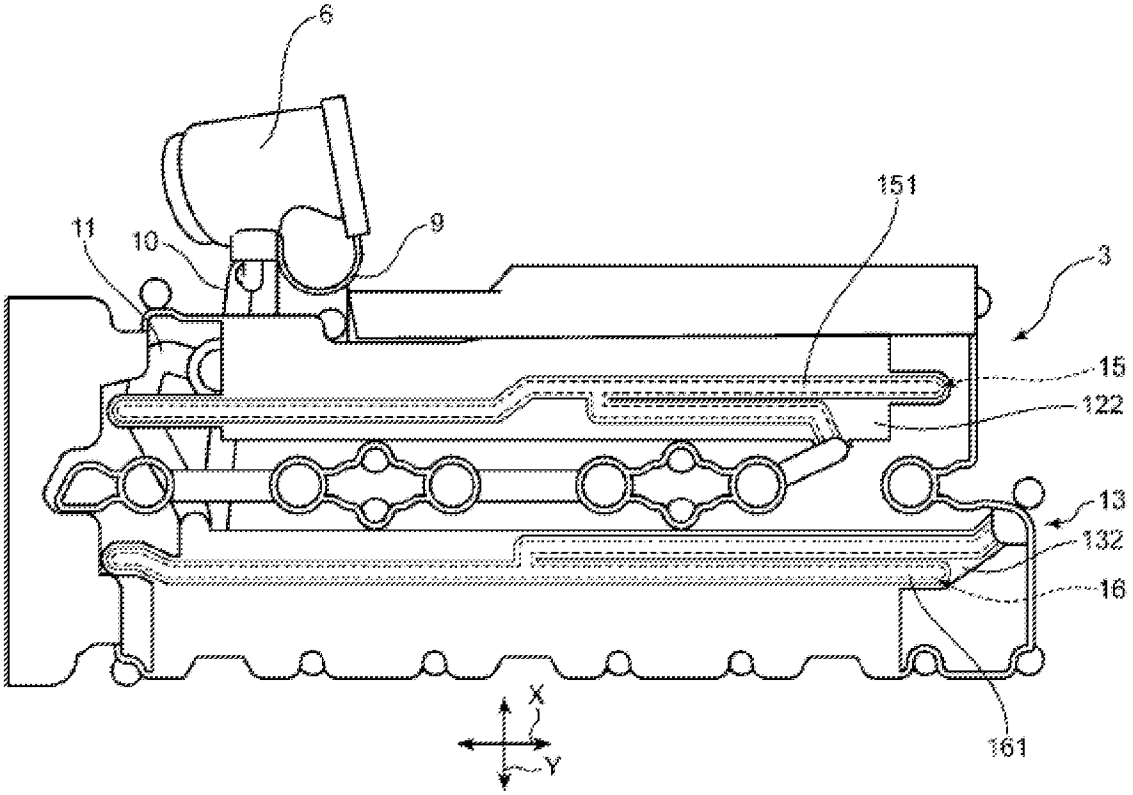
FIG. 9 is a bottom view of the lubricating oil passage adjacent to the oil separation portion and the distribution portion of FIG. 3.

As illustrated in FIGS. 5, 8, and 9, the distribution portion 13 is formed in such a manner that a top plate 131 constituting an outer wall of the head cover 3 and an intermediate plate 132 inside the head cover 3 are joined together so that a tournament chamber 133, which is a space including the plurality of branch passages 13*c* having the tournament structure described above, is formed between the top plate 131 and the intermediate plate 132. The head cover 3 of the present embodiment includes the distribution portion 13 described above, in other words, the head cover 3 including the distribution portion 13 constitutes a part of the blowby gas return apparatus 20.

Figure 6:
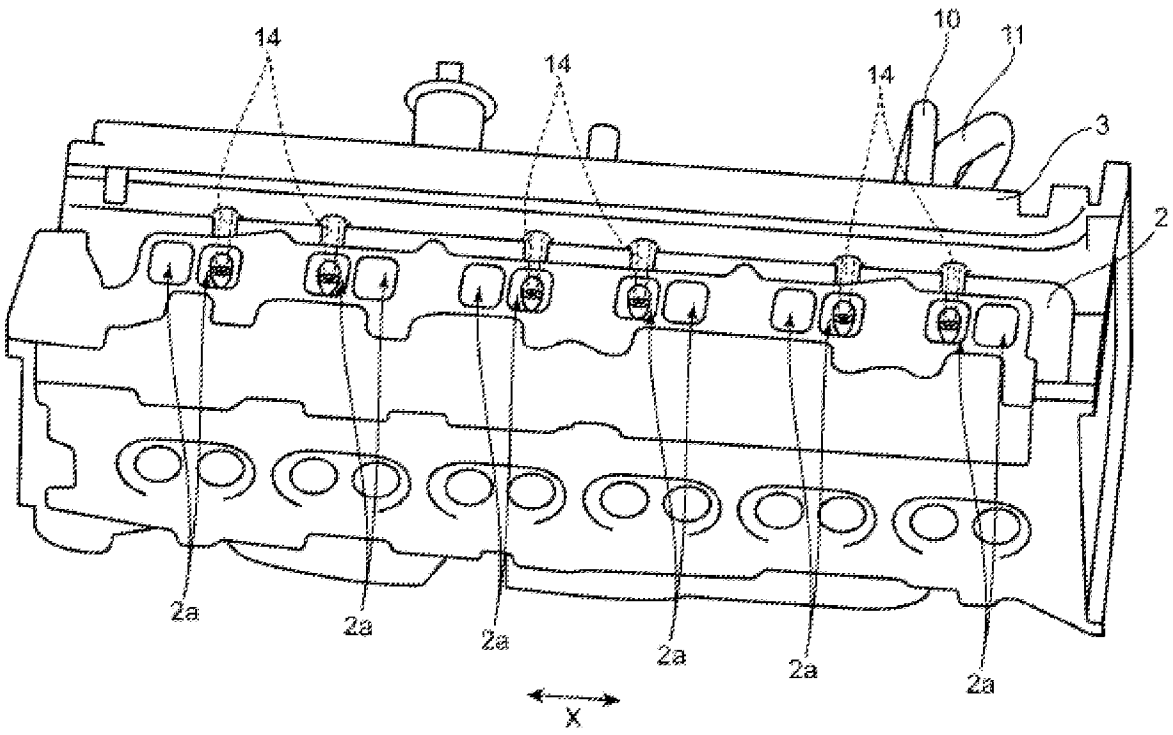
FIG. 6 is a perspective explanatory diagram illustrating a plurality of communication passages that connect, one-to-one, a plurality of intake ports of a cylinder head of FIG. 3 to a plurality of discharge openings of the distribution portion inside the head cover.

As illustrated in FIGS. 5 and 6, the plurality of communication passages 14 are formed penetrating the cylinder head 2 in the up-down direction. Each communication passage 14 allows the intake port 2*a* constituting the intake path of each cylinder inside the cylinder head 2 of the engine 1 and the discharge portion 13*b* located at the outlet of each of the branch passages 13*c* of the distribution portion 13 (refer to FIGS. 5 and 7) to communicate with each other.

As illustrated in FIGS. 2 to 5 and 7 to 9, the oil separation portion 12 is provided inside the head cover 3, communicates with the introduction portion 13*a* of the distribution portion 13 through the return pipe 11, and is disposed upstream of the distribution portion 13 in a blowby gas flowing direction. The oil separation portion 12 has a configuration for separating oil contained in blowby gas and includes, for example, an introduction portion 12*a* through which blowby gas is introduced, an outlet 12*b* through which the blowby gas is discharged, and an oil capturing portion such as a space portion in which the channel sharply widens and a filter that adsorbs oil, the space portion and the oil capturing portion being provided between the introduction portion 12*a* and the outlet 12*b* as illustrated in FIG. 7.

As illustrated in FIGS. 5, 8, and 9, the oil separation portion 12 is formed in such a manner that a top plate 121 constituting the outer wall of the head cover 3 and an intermediate plate 122 are joined together so that a separator chamber 123 including the space portion and the filter for separating oil is formed between the top plate 121 and the intermediate plate 122.

Figure 2:
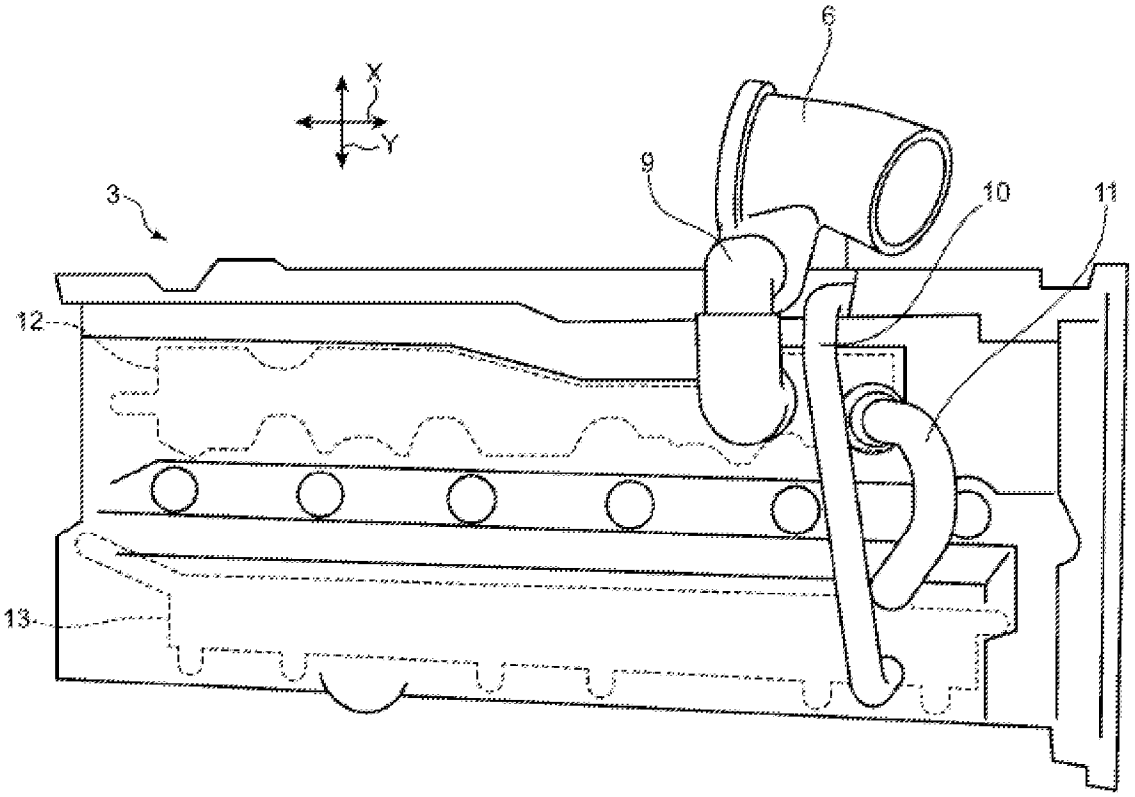
FIG. 2 is a plan view of the head cover of FIG. 1 and its surroundings.

In the present embodiment, inside the head cover 3, the oil separation portion 12 extends in the array direction X of the plurality of cylinders and disposed on an exhaust path side of the plurality of cylinders (the upper side in FIGS. 2 to 4, that is, the side opposite to the side on which the intake ports 2*a* are provided in FIGS. 3 and 5).

Inside the head cover 3, the distribution portion 13 extends in the array direction X and is disposed on the side with the plurality of the intake paths (the lower side in FIGS. 2 to 4, that is, the side on which the intake ports 2*a* are provided in FIGS. 3 and 5).

As illustrated in FIG. 7, the outlet 12*b* of the oil separation portion 12 and the introduction portion 13*a* of the distribution portion 13 are disposed on an end on the same side in the array direction X (the right end in FIG. 7) inside the head cover 3.

As illustrated in FIGS. 2 to 4, the return pipe 11 extends in a direction Y perpendicular to the array direction X and allows the outlet 12*b* of the oil separation portion 12 and the introduction portion 13*a* of the distribution portion 13 illustrated in FIG. 7 described above to communicate with each other. The return pipe 11 is called a PCV hose as a hose included in the blowby gas return apparatus of the PCV system described above.

Figure 11:
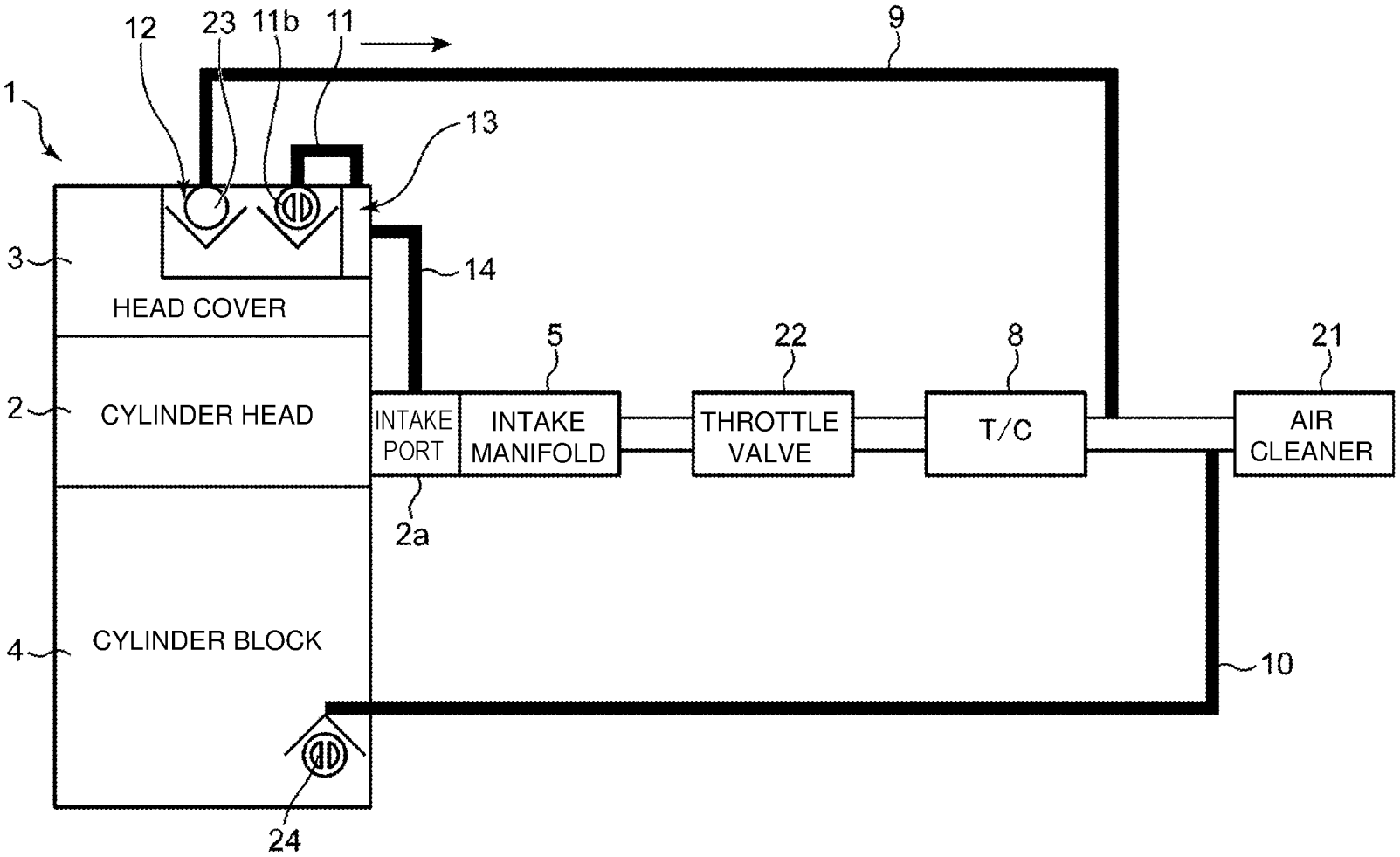
FIG. 11 is a block diagram illustrating the structure of the engine of FIG. 1 and the intake system thereof, specifically, an explanatory diagram illustrating the flow of gas inside the return pipe, the ventilation hose, and the breather hose during engine operation in a boosting region.

In the present embodiment, as illustrated in FIG. 11, the return pipe 11 includes a one-way valve 11*b* (so-called PCV valve) as a restriction portion that restricts the flow of blowby gas in one direction. The one-way valve 11*b* is configured to function as the restriction portion that allows the flow of blowby gas from the oil separation portion 12 to the distribution portion 13 and restricts the flow of blowby gas from the distribution portion 13 to the oil separation portion 12.

In the one-way valve 11*b*, when pressure inside the head cover 3 increases, the one-way valve 11*b* is closed to enable blowby gas to restrict the flow to the return pipe 11.

The lubricating oil passages 15, 16 are disposed adjacent to the oil separation portion 12 and the distribution portion 13, respectively, and have a configuration through which lubricating oil supplied to a valve system (that is, open/close mechanisms of an intake valve and an exhaust valve) of the engine flows. In the present embodiment, as illustrated in FIGS. 5, 8, and 9, the lubricating oil passage 15 is formed in a channel shape having a rectangular cross section by the intermediate plate 122 constituting the oil separation portion 12 and a bottom plate 151 joined together. Accordingly, the lubricating oil passage 15 is disposed adjacent to the lower side of the oil separation portion 12 with the intermediate plate 122 interposed therebetween.

Also, the lubricating oil passage 16 is formed in a channel shape having a rectangular cross section by the intermediate plate 132 constituting the distribution portion 13 and a bottom plate 161 joined together. Accordingly, the lubricating oil passage 16 is disposed adjacent to the lower side of the distribution portion 13 with the intermediate plate 132 interposed therebetween.

In the engine 1 including the blowby gas return apparatus 20 configured as described above and the intake system, as illustrated in FIG. 10, when the engine 1 operates within a natural aspiration region, the turbocharger 8 does not operate and the intake port 2*a* of the engine 1 takes air in by natural aspiration. Accordingly, the intake port 2*a* is put under negative pressure, and air thus flows through the air cleaner 21, the turbocharger 8, the throttle valve 22, the intake manifold 5, and the intake port 2*a* in this order. At this time, since the distribution portion 13 inside the head cover 3 is put under negative pressure through the communication passage 14 together with the intake port 2*a*, the one-way valve 11*b* serving as the restriction portion of the return pipe 11 allows the flow of blowby gas from the oil separation portion 12 to the distribution portion 13. Thus, the blowby gas inside the head cover 3 can be returned to the intake port 2*a* through the oil separation portion 12, the return pipe 11, the distribution portion 13, and the communication passage 14.

Also, during operation in the natural aspiration region illustrated in FIG. 10, since the inside of the cylinder block 4 is put under negative pressure, and a one-way valve 24 provided on the breather hose 10 allows the circulation of air, it is possible to communicate with outside air and feed flesh air from the air cleaner 21 in an atmospheric pressure state to the cylinder block 4 of the engine 1 through the breather hose 10. On the other hand, since a one-way valve 23 provided on the ventilation hose 9 restricts the circulation of gas because the intake path on the upstream side of the turbocharger 8 is not in a predetermined negative pressure state, it is possible to restrict return of the blowby gas from the oil separation portion 12 of the head cover 3 to the upstream side of the turbocharger 8 through the ventilation hose 9.

On the other hand, when the engine 1 operates within a boosting region, the turbocharger 8 boosts the intake air to the intake port 2*a*, which puts the intake port 2*a* under positive pressure. At this time, since the distribution portion 13 inside the head cover 3 is put under positive pressure through the communication passage 14 together with the intake port 2*a*, the one-way valve 11*b* of the return pipe 11 can restrict backflow of the blowby gas from the distribution portion 13 to the oil separation portion 12.

Also, during operation in the boosting region illustrated in FIG. 11, since the one-way valve 24 provided on the breather hose 10 restricts the circulation of gas, it is possible to restrict the flow of the blowby gas from which oil has not yet been separated from the cylinder block 4 of the engine 1 to the turbocharger through the breather hose 10. On the other hand, since the one-way valve 23 provided on the ventilation hose 9 allows the circulation of gas because the intake path on the upstream side of the turbocharger 8 is put under a predetermined negative pressure or higher, it is possible to return the blowby gas from the oil separation portion 12 of the head cover 3 to the turbocharger 8 through the ventilation hose 9.

Characteristics of the Present Embodiment (1)

As illustrated in FIG. 7, the blowby gas return apparatus 20 of the present embodiment includes, inside the head cover 3 of the engine having the plurality of cylinders, the distribution portion 13 including the introduction portion 13*a* though which blowby gas is introduced and the plurality of branch passages 13*c* communicating with the introduction portion 13*a* and branching from the introduction portion 13*a*. Thus, even in a cold climate area, the head cover 3 is warmed up quickly at the start of the engine, and the blowby gas passing through the inside of the introduction portion 13*a* and the plurality of branch passages 13*c* of the distribution portion 13 inside the head cover 3 is also warmed up promptly and can be distributed and returned to the intake paths of the cylinders. Accordingly, it is possible to inhibit condensation of water vapor contained in the blowby gas in the branched return passages.

(2)

As illustrated in FIG. 5, the blowby gas return apparatus 20 of the present embodiment further includes the communication passage 14 that allows the intake port 2*a* constituting the intake path of the cylinder and the discharge portion 13*b* located at the outlet of the branch passage 13*c* to communicate with each other inside the cylinder head 2 of the engine. According to this configuration, the blowby gas distributed by the distribution portion 13 inside the head cover 3 can be directly introduced into the intake port 2*a* through the communication passage 14 inside the cylinder head 2 where temperature largely increases, and it is thus possible to supply the blowby gas to the cylinder while reliably preventing condensation and freezing of water vapor in the blowby gas.

(3)

As illustrated in FIG. 7, in the blowby gas return apparatus 20 of the present embodiment, the plurality of branch passages 13*c* have the tournament structure branching from the introduction portion 13*a* in the plurality of stages. In this configuration, a large number of branch passages 13*c* can be branched from one introduction portion 13*a* within a limited space inside the head cover 3. Also, in this structure, a large number of branch passages 13*c* can be provided without changing the width of the branch passages 13*c*, and it is thus possible to efficiently distribute the blowby gas. In addition, since the plurality of branch passages 13*c* have the tournament structure, flexibility in the layout of blowby gas passages is improved.

(4)

As illustrated in FIG. 7, in the blowby gas return apparatus 20 of the present embodiment, the plurality of branch passages 13*c* having the tournament structure are disposed centered on the intermediate position in the array direction X of the plurality of cylinders. In this configuration, the blowby gas can be uniformly fed to the intake paths of the plurality of cylinders with a simple configuration. Also, such a tournament structure enables easy design of the distribution portion 13.

(5)

As illustrated in FIG. 7, in the blowby gas return apparatus 20 of the present embodiment, the distribution portion 13 includes, in the branch part 13*d* where two of the branch passages 13*c* branch off in the tournament structure, the partition wall 13*e* serving as the narrowing portion that narrows the channel of any one of the two branch passages 13*c*. In this configuration, in the branch part 13*d* where two of the branch passages 13*c* of the tournament structure in the distribution portion 13 branch off, the partition wall 13*e* serving as the narrowing portion narrows the channel of any one of the two branch passages 13*c*, thereby enabling reduction in the flow rate of blowby gas. Thus, it is possible to individually adjust the flow rate of blowby gas in each of the branch passages 13*c* branching off in the plurality of stages in the tournament structure. As a result, it is possible to uniformly feed the blowby gas to the intake paths of the plurality of cylinders while maintaining high uniformity and reduce variations in air-fuel ratio between the cylinders.

(6)

In the blowby gas return apparatus 20 of the present embodiment, the narrowing portion includes the partition wall 13*e* that partially partitions the inside of the branch passage 13*c*. In such a configuration, by providing, as the narrowing portion, the partition wall 13*e* that partially partitions the inside of the branch passage 13*c*, it is possible to more accurately set the flow rate of blowby gas flowing through each branch passage 13*c*.

Note that the narrowing portion may be a configuration other than the partition wall 3*e* described above as long as it narrows the channel area of the branch passage 13*c*, and may be a configuration in which the width of the branch passage 13*c* is narrowed or a perforated plate is inserted into the branch passage 13*c*.

(7)

As illustrated in FIGS. 5, 8, and 9, the blowby gas return apparatus 20 of the present embodiment includes the lubricating oil passage 15 that is disposed adjacent to the distribution portion 13 and through which lubricating oil supplied to the valve system of the engine flows. According to this configuration, the lubricating oil supplied to the valve system of the engine flows through the lubricating oil passage 15 adjacent to the distribution portion 13 immediately after the start of the engine, which makes it possible to immediately thaw ice formed inside the branch passage 13*c* by warming the distribution portion 13 with heat of the lubricating oil. Thus, even after the engine pauses thereafter (that is, after soaking), blowby gas remaining inside the distribution portion 13 is warmed with the heat of the lubricating oil, and it is thus possible to inhibit condensation of water vapor contained in the blowby gas.

In addition, in the present embodiment, since the lubricating oil passage 16 is disposed adjacent to the oil separation portion 12, the blowby gas can further be heated with the heat of the lubricating oil, and it is thus possible to improve the efficiency of separating oil contained in the blowby gas and more reliably inhibit condensation of water vapor contained in the blowby gas.

(8)

As illustrated in FIGS. 2 to 5 and 7 to 9, the blowby gas return apparatus 20 of the present embodiment includes the oil separation portion 12 that is provided inside the head cover 3, communicates with the introduction portion 13*a* of the distribution portion 13, and separates oil contained in the blowby gas. According to this configuration, after the oil separation portion 12 separates oil from the blowby gas to purify the blowby gas, the distribution portion 13 can distribute the purified blowby gas to the branch passages 13*c* after the purified blowby gas passes through the introduction portion 13*a*, and it is thus possible to prevent oil from adhering to the inside of the branch passages 13*c*. In addition, since the oil separation portion 12 is provided inside the head cover 3, even in a cold climate area, the oil separation portion 12 can separate oil in blowby gas warmed up inside the head cover 3, which improves the separation efficiency.

(9)

As illustrated in FIGS. 2 to 5, in the blowby gas return apparatus 20 of the present embodiment, the oil separation portion 12 extends in the array direction X of the plurality of cylinders and is disposed on the exhaust path side of the plurality of cylinders inside the head cover 3. The distribution portion 13 extends in the array direction X and is disposed on the side with the plurality of intake paths inside the head cover 3. The outlet 12*b* of the oil separation portion 12 and the introduction portion 13*a* of the distribution portion 13 are disposed on the end on the same side in the array direction X inside the head cover 3. The return pipe 11 extends in the direction Y perpendicular to the array direction X and allows the outlet 12*b* of the oil separation portion 12 and the introduction portion 13*a* of the distribution portion 13 to communicate with each other.

According to this configuration, since the return pipe 11 extends in the direction Y perpendicular to the array direction X of the plurality of cylinders and allows the outlet 12*b* of the oil separation portion 12 and the introduction portion 13*a* of the distribution portion 13 to communicate with each other, it is possible to shorten the length of the return pipe 11, prevent reduction in the temperature of the blowby gas moving from the oil separation portion 12 to the distribution portion 13, and more reliably inhibit condensation of water vapor contained in the blowby gas.

Note that, while the return pipe 11 is provided outside the head cover 3 in the present embodiment, the return pipe 11 may be provided inside the head cover 3.

(10)

As illustrated in FIG. 10, in the blowby gas return apparatus 20 of the present embodiment, the return pipe 11 includes the one-way valve 11*b* (PCV valve) as the restriction portion that allows the flow of the blowby gas from the oil separation portion 12 to the distribution portion 13 and restricts the flow of the blowby gas from the distribution portion 13 to the oil separation portion 12. According to this configuration, although the distribution portion 13 has a higher pressure than the oil separation portion 12 when the engine operates in the boosting region, the one-way valve 11*b* serving as the restriction portion of the return pipe 11 can restrict backflow of the blowby gas from the distribution portion 13 to the oil separation portion 12.

(11)

According to the configuration of the head cover 3 of the present embodiment, the head cover 3 includes the distribution portion 13 described above, that is, the distribution portion 13 that is provided inside the head cover 3 of the engine having the plurality of cylinders and includes the introduction portion 13*a* through which the blowby gas is introduced and the plurality of branch passages 13*c* communicating with the introduction portion 13*a* and branching from the introduction portion 13*a*. Thus, even in a cold climate area, the head cover 3 is warmed up quickly at the start of the engine, and the blowby gas passing through the inside of the introduction portion 13*a* and the plurality of branch passages 13*c* of the distribution portion 13 inside the head cover 3 is also warmed up promptly and can be distributed and returned to the intake paths of the cylinders. Accordingly, it is possible to inhibit condensation of water vapor contained in the blowby gas in the branched return passages.

What is claimed is:

1. A blowby gas return apparatus that returns blowby gas generated in an engine having a plurality of cylinders to an intake system of the engine, the blowby gas return apparatus comprising:

a distribution portion that is provided inside a head cover of the engine and distributes the blowby gas to intake paths of the cylinders, a communication passage that allows an intake port constituting the intake path of the cylinder and an outlet of the branch passage to communicate with each other inside a cylinder head of the engine, and a lubricating oil passage that is disposed adjacent to the distribution portion and through which lubricating oil supplied to a valve system of the engine flows, wherein the distribution portion includes an introduction portion through which the blowby gas is introduced and a plurality of branch passages communicating with the introduction portion, the plurality of branch passages branching from the introduction portion to communicate with the intake paths.

2. The blowby gas return apparatus according to claim 1, further comprising a separation portion that is provided inside the head cover, communicates with the introduction portion, and separates oil contained in the blowby gas.

3. The blowby gas return apparatus according to claim 2, wherein the separation portion extends in an array direction of the plurality of cylinders and is disposed on an exhaust path side of the plurality of cylinders inside the head cover, the distribution portion extends in the array direction and is disposed on a side with the plurality of intake paths inside the head cover, an outlet of the separation portion and the introduction portion of the distribution portion are disposed on an end on the same side in the array direction inside the head cover, and the blowby gas return apparatus further comprises a return pipe that extends in a direction perpendicular to the array direction and allows the outlet of the separation portion and the introduction portion of the distribution portion to communicate with each other.

4. The blowby gas return apparatus according to claim 3, wherein the return pipe includes a restriction portion that allows flow of the blowby gas from the separation portion to the distribution portion and restricts flow of the blowby gas from the distribution portion to the separation portion.

5. The blowby gas return apparatus according to claim 1, wherein the plurality of branch passages have a tournament structure branching from the introduction portion in a plurality of stages.

6. The blowby gas return apparatus according to claim 5, wherein the plurality of branch passages having the tournament structure are disposed centered on an intermediate position in an array direction of the plurality of cylinders.

7. The blowby gas return apparatus according to claim 6, wherein the distribution portion includes, in a branch part where two of the branch passages branch off in the tournament structure, a narrowing portion that narrows a channel of any one of the two branch passages.

8. The blowby gas return apparatus according to claim 7, wherein the narrowing portion is composed of a partition wall that partially partitions inside of the branch passage.

9. The blowby gas return apparatus according to claim 8, further comprising a lubricating oil passage that is disposed adjacent to the distribution portion and through which lubricating oil supplied to a valve system of the engine flows.

10. The blowby gas return apparatus according to claim 9, further comprising a separation portion that is provided inside the head cover, communicates with the introduction portion, and separates oil contained in the blowby gas.

11. The blowby gas return apparatus according to claim 10, wherein the separation portion extends in an array direction of the plurality of cylinders and is disposed on an exhaust path side of the plurality of cylinders inside the head cover, the distribution portion extends in the array direction and is disposed on a side with the plurality of intake paths inside the head cover, an outlet of the separation portion and the introduction portion of the distribution portion are disposed on an end on the same side in the array direction inside the head cover, and the blowby gas return apparatus further comprises a return pipe that extends in a direction perpendicular to the array direction and allows the outlet of the separation portion and the introduction portion of the distribution portion to communicate with each other.

12. The blowby gas return apparatus according to claim 11, wherein the return pipe includes a restriction portion that allows flow of the blowby gas from the separation portion to the distribution portion and restricts flow of the blowby gas from the distribution portion to the separation portion.

13. A head cover comprising the distribution portion according to claim 1.

* * * * *